United States Patent [19]

Julien et al.

[11] Patent Number: 4,846,527

[45] Date of Patent: Jul. 11, 1989

[54] SUPPORTING DEVICE FOR WHEELCHAIRS

[76] Inventors: Normand Julien, 650, 107e Avenue, Drummondville, Quebec, Canada, J2B 4N2; Clement Proulx, 193 Rageot, St-Germain, Québec, Canada, J0C 1K0

[21] Appl. No.: 171,115

[22] Filed: Mar. 21, 1988

[30] Foreign Application Priority Data

Jul. 20, 1987 [CA] Canada ..... 542547

[51] Int. Cl.[4] ..... A47C 7/54

[52] U.S. Cl. ..... 297/411; 297/417; 297/DIG. 4

[58] Field of Search ..... 297/411, 417, DIG. 10, 297/463, 468, 464, 487, 488, DIG. 4

[56] References Cited

U.S. PATENT DOCUMENTS

| | | | |
|---|---|---|---|
| 2,914,110 | 11/1959 | Schulte | 297/463 X |
| 3,629,880 | 12/1971 | Van Rhyn | 297/DIG. 10 |
| 4,040,665 | 8/1977 | Wallace et al. | 297/417 |
| 4,076,304 | 2/1978 | Deucher | 297/DIG. 10 |
| 4,141,586 | 2/1979 | Goldner | 297/417 X |
| 4,537,446 | 8/1985 | Roney et al. | 297/464 |
| 4,623,194 | 11/1986 | Pillot | 297/DIG. 10 |

*Primary Examiner*—James T. McCall

*Attorney, Agent, or Firm*—Woodling, Krost & Rust

[57] ABSTRACT

This invention relates to mobile equipment such as wheelchairs having lifting means and more particularly to a chest supporting device to hold the subject in an upright and/or sitting position. The supporting device is made up of two rigid segments placed at the chest level and further comprise a belt extending across same to firmly hold a patient in an upright or sitting position.

18 Claims, 3 Drawing Sheets

SUPPORTING DEVICE FOR WHEELCHAIRS

FIELD OF THE INVENTION

This invention relates to mobile equipments such as wheelchairs having lifting means and more particularly to chest supporting means to hold the subject in the upright and/or sitting position.

DESCRIPTION OF THE PRIOR ART

Numerous types of wheelchairs have been designed in an effort to accommodate the needs of the orthopedically disabled person.

Recently, there has been a recognition of the need for equipment to elevate such a person from a horizontal or sitting position to a standing position.

The advantages of such wheelchairs are well-known. Repeated movements, from sitting to an upright position and return, increases the blood supply and stimulates the blood circulatory system.

By means of such wheelchairs, the handicapped person is able to perform his (her) day-to-day functions.

However, it has been observed that such wheelchairs having elevation means could not be used by all handicapped persons or invalids. In fact, for certain handicaps or invalidities, the subject has insufficient, or no muscular control to remain in a stable position against the upright supporting plan represented by the raised articulated structure of such a wheelchair.

Therefore, it is important to provide these people with an additional device that will support them in the upright and even in the sitting position and prevent them from the danger of slipping sideways and/or having their legs or torso collapse.

Many supporting devices have been developped to be adapted to such wheelchairs so as to provide additional support in upright and/or sitting position.

U.S. Pat. No. 4,623,194 (PILLOT) shows a body supporting device comprising two partially bent rigid segments, each mounted laterally on the corresponding upright of the backrest by an articulated system which holds and locks said segment in a vertical orientation in which it represents an arm rest or in a horizontal orientation in which it constitutes a thoracic half belt for the subject.

Although this device supports the handicapped person in an upright position, it is difficult for same to manipulate because he (she) has to pivot the support near his (her) torso in order to put same in the proper position, that is to support his (her) chest. By so doing, subject has difficulties rotating such an arm rest relative to the uprights because it may rub against the torso or the chest of the subject during the rotation. Therefore, the subject has to contort him(her)self to permit the rotation of the arm rest.

U.S. Pat. No. 4,054,319 (FOGG Jr. et al) shows a wheelchair having a standing mechanism and further comprising a pair of padded chest restraints adjustable to accommodate occupants having different body measurements. This wheelchair is also equipped with shoulder straps.

U.S. Pat. No. 3,640,571 (KEROPIAN) shows a wheelchair having support plates for laterally supporting a patient in a sitting position. A belt is also provided so as to interconnect the support plates and positively restrains the patient to the chair.

U.S. Pat. Nos. 4,456,086 (WIER et al), 3,807,795 (WEANT et al) and 3,787,089 (WRETHANDER) show mobile equipments for partially paralyzed persons. These equipments are provided with chest and shoulder straps assembly.

U.S. Pat. No. 4,065,179 (TAKASAKI) shows a nursing carriage for supporting a body of an infant or a disabled person having embracing arms which can be locked in place to hold said body. The embracing force of the arms is determined by springs placed on said arms.

The above-described belts provide a good support but are difficult to fasten and to manipulate. Therefore, the handicapped persons or the subject need help for fastening or unfastening said belts.

OBJECTIVES OF THE PRESENT INVENTION

The first object of the present invention is to provide a securing system used in conjunction with wheelchairs.

The second object of the present invention is to provide a securing system which is easy to manipulate by a handicapped person.

Another object of the present invention is to provide a securing system which can be easily unfastened if necessary.

Another object of the present invention is to provide a securing system suitable for retrofitting on existing wheelchairs.

Another object of the present invention as above described is to provide a securing system being easily adjustable to the morphological characteristics of the subject.

Another object of the present invention is to provide a securing system which is easily adjustable to accommodate the subject.

Another object of the present invention is to provide a securing system for paraplegic which enhances his(her) confidence and his(her) ability to accomplish his(her) tasks.

To attain the above-described objects, the torso-supporting device for a wheelchair of the type including a backrest having a pair of uprights, a seat and a frame is characterized in that it comprises:

- two rigid segments mounted frontwardly on said uprights;
- a belt fixed on one of said segment so as to support the subject and further comprising a ring or the like in order to provide a quick and secure way to attach said belt and to hold the subject.

DESCRIPTION OF A PREFERRED EMBODIMENT

Figure 1:
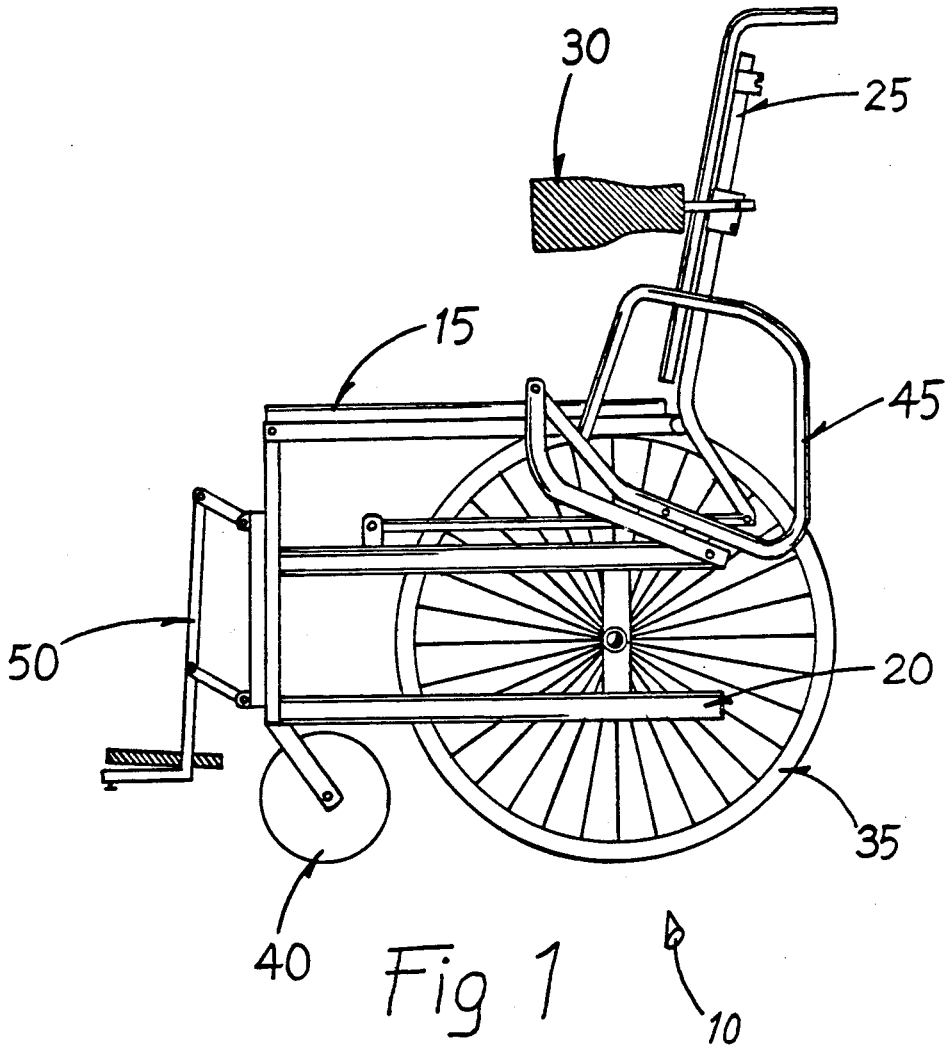
FIG. 1 is a side view of the body supporting device of the present invention.

Referring to the drawings where like reference numerals refer to similar parts throughout the drawings, there is shown in FIG. 1 a wheelchair 10 comprising a frame 20, a sitting surface 15, a backrest 25 for a patient, arm rests 30 and 30; large drive-wheels 35, a pair of directing wheels 40 and a footrest portion 50. The wheelchair 10 is a.lso provided with lifting means generally referred to as 45.

Figure 2:
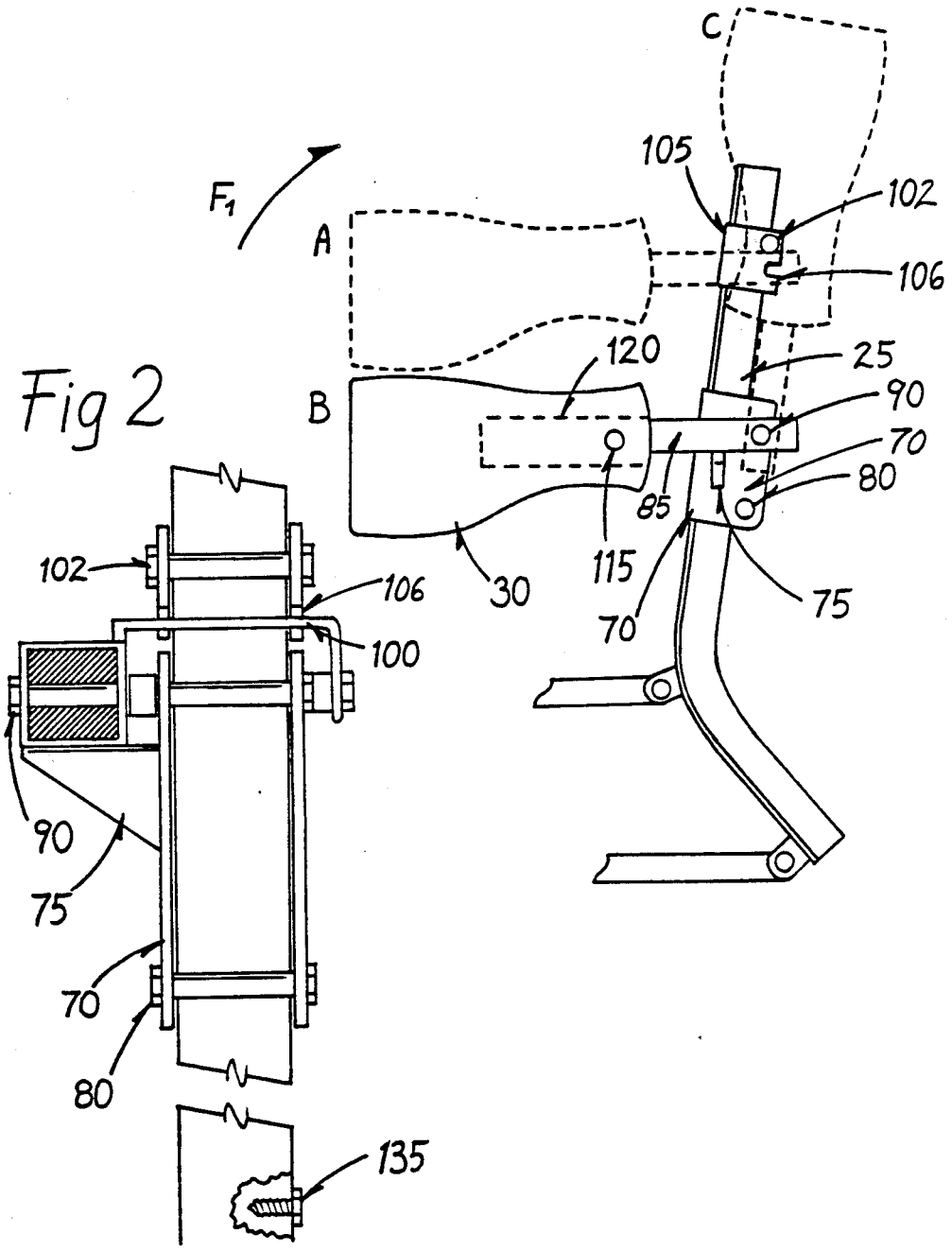
FIG. 2 is a detailed view of the clamping device with elements illustrated in cross-section and broken lines.

Referring now to FIG. 2, the construction of the arm rest 30 and its mounting structure embodying the present invention are illustrated in greater detail. A channel-shaped bracket 70, the channel of which is of sufficient width to accommodate the back-rest upright 25 and is movably tightened thereagainst by bolts 80 and 90 in order to be moveable along said back-rest upright 25.

The said arm rest 30 is supported by a tube 85 of a generally square shape, being pivotably fixed by means of a bolt 90 to said clamping device 70. The rotation of said arm rest 30 is possible in the direction of the arrow F1 in FIG. 2 and said rotation is limited by the stopper 75.

The clamping device 70 is moveable upwards and downwards along the back-rest upright 25 and is held in the upper position by means of a locking device 100 engaged in another clamping device 105 having an opening 106 to receive said locking device 100. Said locking device 105 is movably secured to said upright 25 by bolt 102.

The arm rest according to the present invention has two positions referred as positions A and B shown in FIG. 2. The desired position is chosen according to the needs of the patient. It is to be understood that the upper clamping device 105 can be adjusted at any intermediate position along said upright 25 by loosening the bolt 102 and moving said upper clamping device to the desired position.

When the position of the upper clamping device 105 is adjusted by an experienced or skilled person such as a physical therapist, no further adjustments are necessary and the sliding member 70 is simply moved along said upright 25 between position A and B, corresponding to two most common positions.

It is not necessary to lock the clamping device 70 structure in the lower position because the movements of same are limited in the said lower position by a screw 135. Said screw 135 represents a lower stop to the sliding member 70, but any other means may be used.

The length of the the arm rest 30 may be modified by means of another sliding member 120 inside said arm rest. A screw 115 disposed in the sliding member can be tightened against the tube 85 to lock the sliding member 120 to the bar at a desired position and prevent further movements of the member and consequently the arm rest 30.

Figure 3:
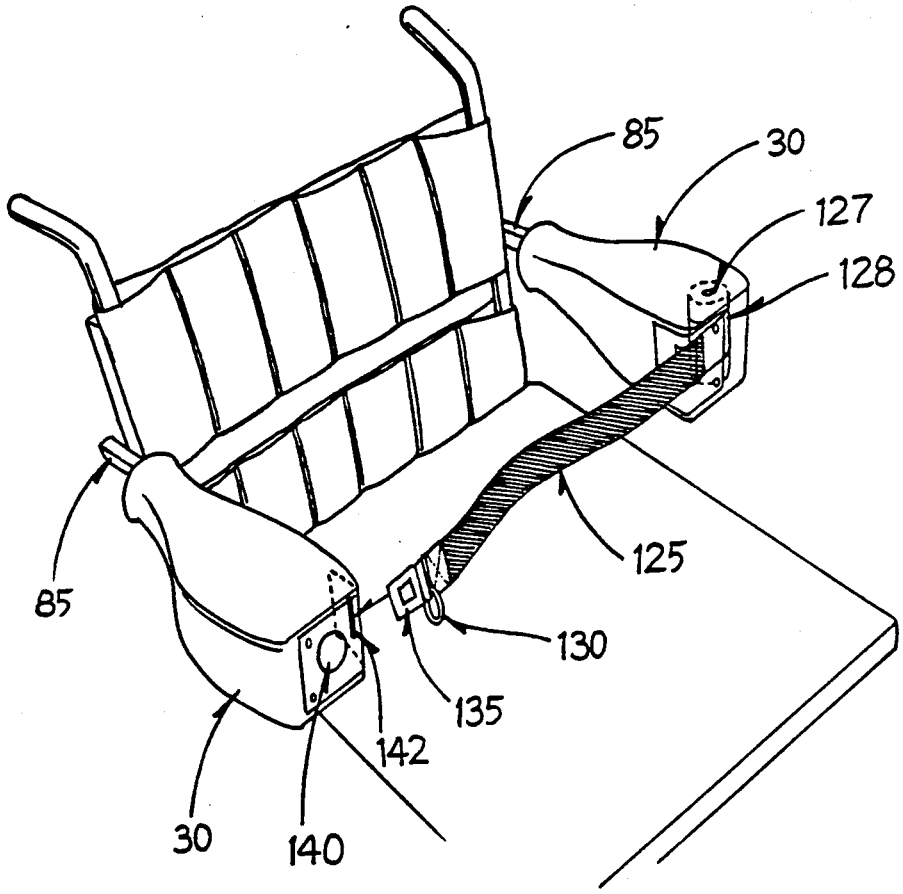
FIG. 3 is a perspective view of the body supporting device illustrating the means by which the belt is secured to the arms.

In order to properly hold the patient, the arm rest is provided with a belt 125 placed within same, as shown in FIG. 3. 125 passes around the chest of the patient (not shown), and below the arm joints, thus giving the said patient who is immobilized complete freedom of movement.

The said belt 125 is fixed at one extremity inside the arm rest 30 and has on the other extremity a buckle 135 and a ring 130. The said ring 130 is used by the patient such as a paraplegic to easily secure said buckle in the buckle locking device 140 inside the other arm rest 30' which is otherwise similar to the arm rest 30.

The buckle locking device 140 is protcted by a plate made of a first and a second plate, welded, fixed or bolted together so as to form a right angle. A similar plate is placed on the arm-rest 30.

The length of the belt 125 is normally selected to be substantially equal to the distance between the two arm rests 30, 30' such that the patient is supported in an upright position upon fastening the buckle into the buckle locking device 140. If desired the length of the belt could be made adjustable through use of an adjustable buckle 135 or otherwise so as to allow one to selectively vary the belt length in a given chair for a particular or varied application.

The armest 30 and 30' may be pivoted to a vertical position C so as to give the patient an easy access to the chair by the sides of same.

The invention is not limited to the embodiment described and various changes may be made in details of the construction without departing from the spirit and scope of the present invention as defined by the appended claims.

We claim:

1. A device for supporting the body of a handicapped person in a wheelchair of the type including a backrest having a pair of uprights, a seat, a footrest assembly and a frame, the device comprising: two generally horizontal and parallel extending arm-rests; one of said arm-rest including a retractable belt for selective extension off of the end of said one arm-rest, said retractable belt having an end and the other said arm-rest including a locking device at its end to detachably secure said end of said belt thereto.

2. A device for supporting the body according to claim 1 wherein each arm-rest is movable upwards and downwards on the corresponding upright of the backrest.

3. A device for supporting the body according to claim 1 wherein each arm-rest further comprises means to allow the rotation of same along an axis perpendicular to said upright so as to be parallel the said upright.

4. A device according to claim 1 wherein said belt is provided with a buckle at one extremity and said locking device comprises a buckle receiving means.

5. A device according to claim 4 wherein the belt is provided with means to permit an easy fastening.

6. A device according to claim 5 wherein said means to permit an easy fastening includes a ring attached to said buckle.

7. A device according to claim 1 wherein the belt further comprises means to prevent same from being unfastened when the subject is in an upright position.

8. A device according to claim 1, 2 or 3 wherein said arm-rests include a means allowing the elongation or shortening of same so as to allow adjustment according to the size of the subject.

9. A device for supporting the body of a handicapped person in a wheelchair of the type including a backrest having a pair of uprights, a seat, a footrest assembly and a frame, the device comprising a first and a second horizontal extending arm-rest, retractable support means fixed to said first generally horizontal extending arm-rest, securing means fixed to said second generally horizontal extending arm-rest wherein said securing means interacts with said retractable support means to support the upper portion of the body.

10. A device for supporting the body according to claim 9 wherein each of said two generally horizontal extending arm-rests is movable upwards and downwards on the corresponding upright of the backrest.

11. A device for supporting the body according to claim 9 wherein each of said two generally horizontal extending arm-rests further comprises means to allow rotation of same along axis perpendicular to said upright so as to be parallel to said upright.

12. A device according to claim 9 wherein the retractable support means comprises a belt.

13. A device according to claim 12 wherein said belt is provided with a buckle at one end and said securing means comprises a buckle receiving means.

14. A device according to claim 13 wherein said buckle is provided with easy fastening means.

15. A device according to claim 14 wherein said easy fastening means comprises a ring attached to said buckle.

16. A device according to claim 12 wherein said securing means further comprises means to prevent same from being unintentionally unfastened when the person is in an upright position.

17. A device according to claim 9, 10, or 11 wherein each of said generally horizontal extending arm-rests comprises means to elongate or shorten same so as to be adjustable according to the size of the person.

18. A device for supporting the body of a handicapped person in a wheelchair of the type including backrest having a pair of uprights, a seat, a footresr assembly and a frame, the device comprising a first and a second generally horizontal extending arm-rest, a belt fixed to said first generally horizontal extending arm-rest with a winding mechanism for said belt situated within said first generally horizontal extending arm-rest, a buckle fixed to said belt, a buckle receiving means fixed to said second generally horizontal extending arm-rest, said buckle means including a buckle releasing means, and said buckle cooperating with said buckle receiving means to hold the body of the handicapped person.

* * * * *